US006655996B1

(12) United States Patent
Ng

(10) Patent No.: US 6,655,996 B1
(45) Date of Patent: Dec. 2, 2003

(54) WALL SOCKET WITH SWAGED PRONGS

(75) Inventor: Yuk Hung Ng, Kowloon (HK)

(73) Assignee: Helms-Man Industrial Co., Ltd. (HK)

( * ) Notice: Subject to any disclaimer, the term of this patent is extended or adjusted under 35 U.S.C. 154(b) by 0 days.

(21) Appl. No.: 10/186,666

(22) Filed: Jul. 2, 2002

(51) Int. Cl.[7] ..... H01R 13/415
(52) U.S. Cl. ..... 439/741
(58) Field of Search ..... 439/741, 870, 439/84

(56) References Cited

U.S. PATENT DOCUMENTS

| | | | | | |
|---|---|---|---|---|---|
| 4,812,130 | A | * | 3/1989 | Altenschulte et al. | 439/741 |
| 5,046,971 | A | * | 9/1991 | Ruggiero et al. | 439/741 |
| 5,082,460 | A | * | 1/1992 | Legrady | 439/84 |
| 5,147,228 | A | * | 9/1992 | Miller et al. | 439/741 |
| 5,588,882 | A | * | 12/1996 | Hung | 439/741 |
| 6,231,401 | B1 | * | 5/2001 | Chooi Au Yong et al. | 439/741 |

* cited by examiner

*Primary Examiner*—Gary Paumen
(74) *Attorney, Agent, or Firm*—Browdy and Neimark

(57) ABSTRACT

A wall plug device for connecting an electrical appliance to a socket of a power supply system. The device is composed of: a housing having an outer surface and an inner surface and provided with two pairs of passages, each pair including a first passage and a second passage; and two electrical contact prongs, each having a main body portion and a connecting portion, the main body portion extending to a first end of the prong for making electrical contact with the socket outside the housing and the connecting portion extending to a second end of the prong that is remote from the first end. The connecting portion has an anchor element that extends through the first passage of a respective pair of passages and an electrical connection element that extends through the second passage of the respective pair of passages, and the anchor element is deformed from a first configuration in which the anchor element can be inserted through the first passage to a second configuration in which the anchor element is secured in the housing.

6 Claims, 1 Drawing Sheet

WALL SOCKET WITH SWAGED PRONGS

FIELD OF THE INVENTION

The present invention relates to a wall plug device having metallic flat-blade electrical contact prongs.

BACKGROUND OF THE INVENTION

Many electrical appliances use common line current which is supplied from electrical outlet sockets. The sockets accept a pair of flat blade-type prongs, each rectangular in cross section. The standard prongs are ¼ inch wide, slightly less than 1/16 inch thick, and almost ¾ of an inch long. The two prongs are set ½ inch apart on centers. Usually a hole for a third, grounding prong is provided. The grounding prong is usually round in cross section, instead of rectangular.

If the appliance is electrically isolated from the line current, as by a transformer or double insulation, then the third grounding prong is not necessary and only the two flat prongs need be provided and inserted into the socket for electrical powering of the appliance. Often, when a transformer is provided, the transformer is packaged in a small plastic box or housing, with low voltage wires (from the low voltage side of the transformer) running from the box to the appliance proper. The transformer housing, rather than a separate jack or "plug" proper, then is placed directly against the socket when the prongs are inserted to power the appliance.

Such transformer housings are almost always molded of rubber or plastic insulating materials. The prongs need to be fastened to the box or housing in such a way that they are firmly held and that electrical contact paths can be made to them inside the housing, after which the (usually two) mating parts of the housing are closed.

In the prior art, a conventional method of fastening prongs to transformer and other plug-type housings has been to mold them directly into the plastic. The housing mold has been provided with passages for accepting the prongs and holding them during the plastic injection. Because the prongs must protrude on both the outside and the inside of the housing for electrical connection, both the male and female halves of the mold required passages.

Deficiencies in the prior art such as noted above have been overcome by the invention described in my issued U.S. Pat. No. 5,588,882, which is composed of a prong structure and method of attaching prongs to a housing to form a plug in a manner that reduces mold expense, cuts molding cycle time, and improves mechanical strength. Passages are provided in the molded housing that accept the prongs after the housing is molded and cooled. Each prong includes a body portion having the standard dimensions needed for insertion into a wall socket. At the point where the body is to meet the outer surface of the housing, the prong narrows at a shoulder to form a neck that is inserted into the passage of the housing and fits there snugly. At the end of the neck, adjacent the inner surface of the housing when the neck is fully inserted into the passage, is a twist portion, of reduced width, that separates the neck from the head of the prong. The twist portion lies between the neck and the head of the prong, and has, adjacent its width, opposing ledges or abutment surfaces on the neck and head. The head protrudes from the inner surface of the housing when the neck is fully inserted. After insertion, the head is twisted so that underside or abutment surfaces of the head, called the chin surfaces, rest against the inner surface of the housing.

Thus, after insertion and twisting, the prong is held longitudinally between the shoulder and the chin surfaces. The prong is also held against rocking and rotating about its length by the snug fit of the neck in the housing passage.

BRIEF SUMMARY OF THE INVENTION

The present invention provides a novel prong structure and method offering improvements over the prior art described above To this end, the invention provides a wall plug device for connecting an electrical appliance to a socket of a power supply system. The device is composed of: a housing having an outer surface and an inner surface and provided with two pairs of passages, each pair including a first passage and a second passage; and two electrical contact prongs, each having a main body portion and a connecting portion, the main body portion extending to a first end of the prong for making electrical contact with the socket outside the housing and the connecting portion extending to a second end of the prong that is remote from the first end. The connecting portion has an anchor element that extends through the first passage of a respective pair of passages and an electrical connection element that extends through the second passage of the respective pair of passages, and the anchor element is deformed from a first configuration in which the anchor element can be inserted through the first passage to a second configuration in which the anchor element is secured in the housing.

DETAILED DESCRIPTION OF THE INVENTION

Figure 2:
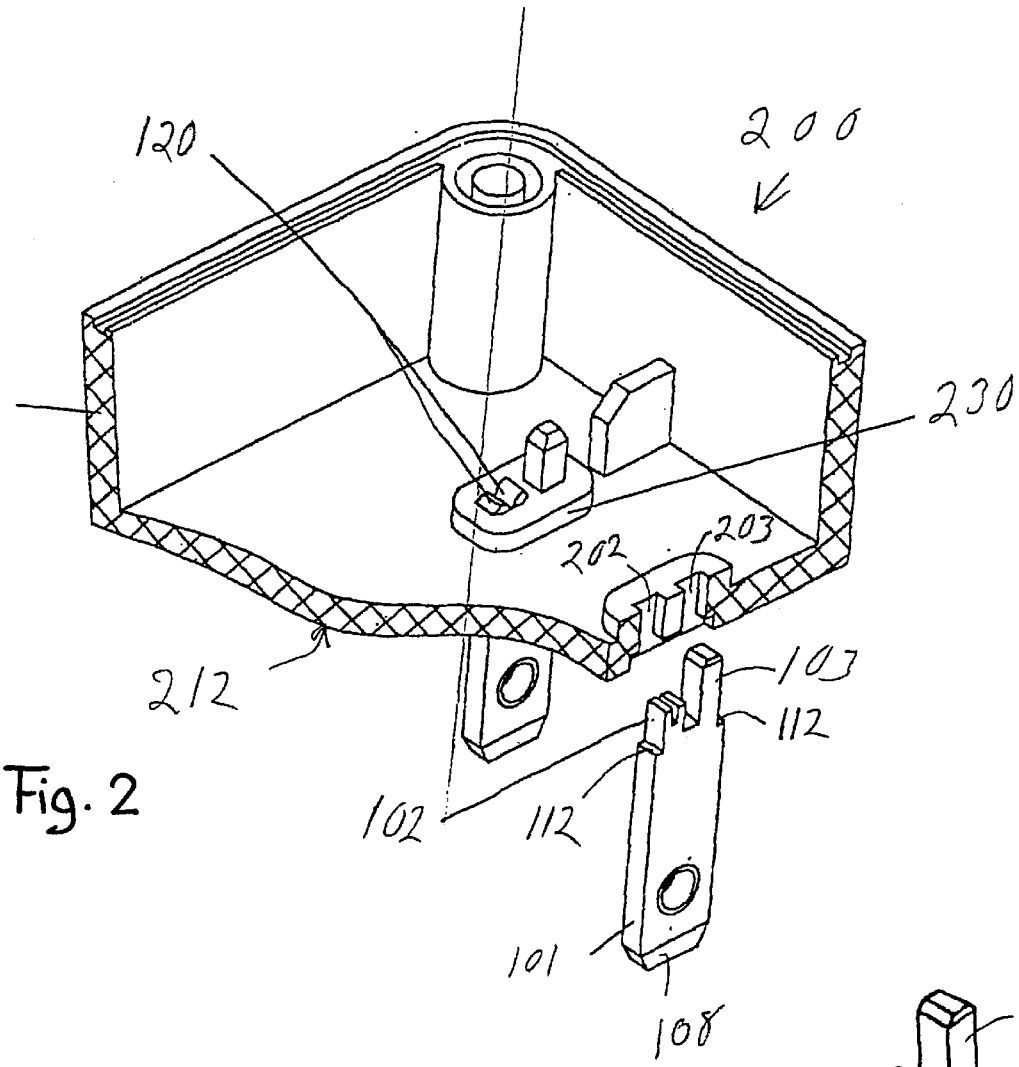
FIG. 2 is partially exploded perspective detail view of a part of the housing component of FIG. 1.
Figure 1:
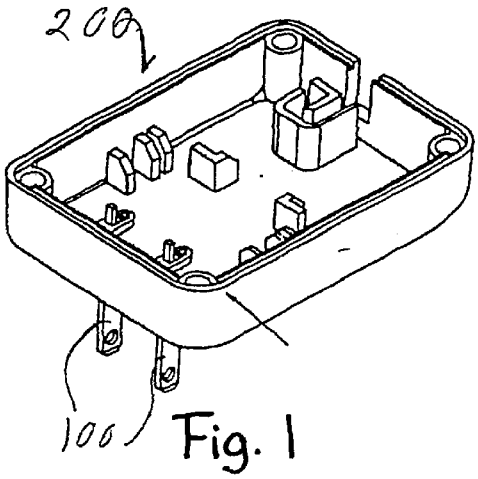
FIG. 1 is a perspective view of one preferred embodiment a housing component of an electrical wall plug according to the invention.

The present invention relates to an electrical contact prong, an insulating housing, and a system for combining them to form an electrical "plug" for insertion into a conventional wall socket carrying regular line current. FIG. 1 is a perspective view of one component 200 of such a housing provided with two electrical contact prongs according to the invention. FIG. 2 is a partially exploded perspective view of a portion of the component of FIG. 1 showing one prong 100 inserted and a second prong 100 not yet inserted into housing component 200. The housing will be completed by a mating component (not shown) secured to component 200 to form an enclosure containing at least one electrical part, such as a current conducting or converting unit. For example, the electrical part may be a transformer (not shown) that will be conductively connected to prongs 100. A transformer in housing 200 might be used to produce electricity at a lower voltage than line voltage to be sent out through a wire to the appliance. The housing 200 may alternatively house a simple electrical line plug for power supply to an electrical appliance, etc., in which two conductors of an electrical supply cord are fastened to prongs 100.

Neither the exact form of the housing nor the nature of the unit is a feature of the present invention.

Housing 200 will generally be formed of injection molded plastic, phenolic resin, hard rubber, ceramic or other non-conductive material. The complete housing with both prongs 100 attached is intended to be plugged into a wall socket.

Prongs 100 are metallic so as to conduct electricity from the wall socket into the housing to provide line current to the transformer primary or other electrical part. Prongs 100 are preferably identical to one another and may be for example formed of a copper base that is plated with nickel. For example, when the electrical part in housing 200 is a transformer, prongs 100 are connected to the ends of the transformer primary, which has no direct connection to the appliance, so that no ground prong is required, the plug need not be polarized, and the two prongs may be identical.

As best seen in FIG. 2, each prong 100 includes: a main body portion 101 which serves as the electrical contact to be inserted in the wall socket; and a connecting portion 102, .103 that is preferably smaller in at least one cross-sectional dimension than main body portion 101. In the illustrated embodiment, portion 102, 103 is narrower, but not thinner, than portion 101. However, portion 102, 103, can alternatively be thinner, or both thinner and narrower, or can have the same cross-sectional dimensions as main body portion 101.

The connecting portion is composed of an anchor element 102 for mechanically connecting prong 100 to housing 200 and an electrical connection element 103 for connecting prong 100 to an electrical part within the enclosure or a wire of an electrical power cord. For example, the electrical part may have two sockets each intended to receive element 103 of a respective prong 100.

The approximate preferred dimensions of main body portion 101 are ¼" by 3/64" by ⅝".

The two connecting parts 102, 103 are inserted through respective through passages 202, 203 of housing 200. Preferably, the cross-sectional dimensions of passage 202 should be nearly identical to the cross-sectional dimensions of anchor element 102. The cross-sectional dimensions of passage 203 should be at least as large as the cross-sectional dimensions of electrical connection element 103. In the illustrated embodiment, each set of passages 202 and 203 is formed in a raised boss 230 on the interior of the housing 200.

An abrupt difference in cross-section between body portion 101 and connecting portion 102, 103 creates, at each side of the connecting portion, a ledge or shoulder 112 that faces away from the distal tip or free end 108 of main body portion 101. When elements 102 and 103 are fully inserted into respective passages 202 and 203, shoulders 112 rest against the outer surface 212 of housing 200.

Connecting part 102 is bifurcated to provide two fingers 120 that are separated by a groove. The depth of passage 202 is preferably substantially equal to the distance from shoulder 112 to the bottom of the groove.

To secure a prong 100 in place, elements 102 and 103 are simply inserted into associated passages 202 and 203, the prong and housing are held securely in position by any suitable means, such as in a stamping machine, and fingers 120 are deformed, as by a swaging operation, into the shape shown for the prong at the left-hand side in FIG. 2. Here, fingers 120 are deformed away from one another so that a portion of boss 230 is clamped between fingers 120 and shoulders 112. Then, after both prongs have been fastened in place, an electrical part can be connected to the connection element 103 of each prong in the manner described above or in any other suitable manner.

Figure 3:
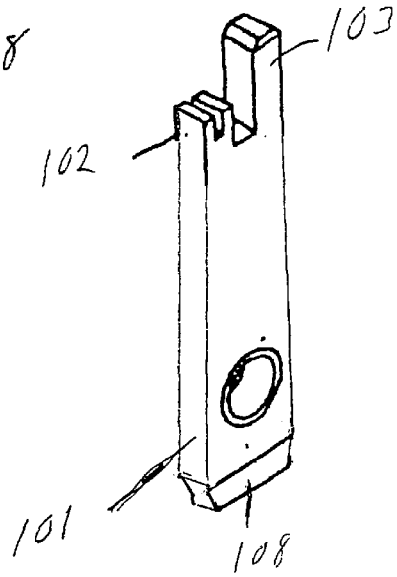
FIG. 3 is a perspective view of a modified form of one component of the housing component of FIG. 1.

FIG. 3 depicts a modified form of construction of each prong 100, according to which shoulders 112 are eliminated. Shoulders 112 can be eliminated because each prong 100 will be properly positioned with the aid of an abutment surface presented by a part of housing 200 between passages 202 and 203. The prong shown in FIG. 3 will be secured in place in the manner described above with respect to the embodiment of FIG. 2.

The invention has been described with reference to a two-prong connector. The invention can easily be applied to a connector that additionally has a ground prong. In this case, component 200 could be provided with a third pair of passages identical to each of the pairs of passages described and illustrated herein and the ground prong could be provided with a connecting portion identical to connecting portion 102, 103.

It will be understood that the example of a transformer housing does not limit the invention to use with transformers or transformer-type housings. In general, the foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. A wall plug device for connecting an electrical appliance to a socket of a power supply system, said device comprising:

a housing having an outer surface and an inner surface and provided with two pairs of passages, each pair including a first passage and a second passage; and two electrical contact prongs, each having a main body portion and a connecting portion, said main body portion extending to a first end of said prong for making electrical contact with the socket outside the housing and said connecting portion extending to a second end of said prong that is remote from said first end, wherein said connecting portion comprises an anchor element that extends through said first passage of a respective pair of passages and an electrical connection element that extends through said second passage of the respective pair of passages, and said anchor element is deformed from a first configuration in which said anchor element can be inserted through said first passage to a second configuration in which said anchor element is secured in said housing.

2. The device of claim 1 wherein said anchor element comprises two fingers that extend parallel to one another when said anchor element has said first configuration and that are bent away from one another when said anchor element has said second configuration.

3. The device of claim 2 wherein said electrical connection element is configured to mate with a receptacle of an electrical part installed in said housing.

4. The device of claim 1 wherein said first passage of each said pair of passages has a generally constant rectangular passage cross section and extends between said housing outer surface and said housing inner surface.

5. The device of claim 1 wherein the housing has two raised bosses that project from the said inner wall, and each of said pairs of passages extends through a respective one of said bosses.

6. The device of claim 1, wherein said main body portion of each of said prongs has a rectangular cross section measuring approximately ¼ inch wide by approximately 3/64 inch thick and a length of approximately ⅝ inch long.

* * * * *